United States Patent [19]

Pawloski

[11] 3,972,218

[45] Aug. 3, 1976

[54] FLUID ACTUATED TOOL

[76] Inventor: James A. Pawloski, P.O. Box 155, Pomfret Center, Conn. 06259

[22] Filed: Dec. 23, 1974

[21] Appl. No.: 535,351

[52] U.S. Cl. ..... 72/407; 72/452; 72/453.16

[51] Int. Cl.[2] ..... B21D 7/06

[58] Field of Search ..... 72/407, 453, 452; 91/290, 291

[56] References Cited

UNITED STATES PATENTS

| | | | |
|---|---|---|---|
| 2,396,562 | 3/1946 | Forss | 72/407 |
| 3,037,208 | 6/1962 | Haberstump | 72/407 |
| 3,079,900 | 3/1963 | Hunnicutt | 91/290 |
| 3,323,346 | 6/1967 | Spangler | 72/407 |
| 3,427,837 | 2/1969 | Faulconer | 72/407 |
| 3,552,270 | 1/1971 | Lange | 91/291 |
| 3,772,907 | 11/1973 | Rider | 72/453 |

FOREIGN PATENTS OR APPLICATIONS

| | | | |
|---|---|---|---|
| 11,884 | 1/1900 | Sweden | 91/291 |

*Primary Examiner*—Lowell A. Larson
*Assistant Examiner*—Gene P. Crosby
*Attorney, Agent, or Firm*—Arthur T. Fattibene

[57] ABSTRACT

A fluid actuated tool for effecting a positive predetermined crimping or cutting operation on a work piece having a bleed arrangement which will prohibit the tool from completing its complete cycle of operation if the pressure of the actuating fluid falls below a pressure sufficient to effect a desired cut or crimp.

6 Claims, 6 Drawing Figures

FLUID ACTUATED TOOL

PROBLEM

Heretofore various types of tools have been made to crimp or cut a work piece. For example, in the wire and/or electronic industries there are many operations which require a terminal or the like to be secured to the end of a wire. In many instances such terminals are secured to a wire by a crimping operation. Frequently such crimping operations are performed by fluid actuated tools as well as by mechanical actuated crimps. Where such crimping operations are required, and in particular in those operations requiring rigid specifications to be met, it is imperative that the crimp so made withstand prescribed forces and/or stresses called for by such specifications. When fluid actuated tools are used to perform such operations, they are generally connected to a source of fluid that is maintained under a predetermined pressure necessary to perform the crimping operation to satisfy the desired specification requirements for which the crimped work piece is designed. However, in practice, it is difficult to maintain the pressure of the activating fluid constant at all times. Therefore, in the event that the pressure of the activating fluid falls below the prescribed pressure, the resulting crimp formed by the known fluid actuated tools would be weaker than that required. As a result such weakened crimps are difficult to detect as they are not readily apparent by visual observation. Thus when such weakened crimped work pieces are placed in operation, they invariably will fail in time. Unless extreme care is maintained in keeping the activating fluid under the prescribed pressure at all times, and/or by effecting costly quality control inspection on each piece so formed, satisfactory quality control on such work pieces cannot be reasonably maintained. Also, as such work is generally performed by relative unskilled workers, and the work for the most part is done with monotonous repetition and speed, little, if any, attention is likely to be paid by the worker to the prescribed operating pressure necessary to make a crimp which may be called for by certain specifications. As a result, large amount of such work can be wasted and/or, if undetected, result in the production of a defective product which further compounds the waste.

OBJECTS

An object of this invention is to provide a fluid actuated tool which is constructed in a manner which renders it impossible for it to go through its entire cycle of operation should the pressure of the activating fluid fall below a predetermined pressure necessary to effect the desired crimp or cut.

Another object is to provide a fluid actuated tool in which the force applied to a workpiece can be readily adjusted within predetermined limits.

Another object is to provide a fluid actuated tool by which a relatively unskilled worker can readily ascertain when the operating pressure of the activating fluid is rendered insufficient to form a desired crimp or cut.

Another object is to prove a fluid actuated tool constructed so as to provide for a positive crimping and release cycle.

Another object is to provide a fluid actuated tool constructed in a manner in which the workpiece cannot be released in the event the pressure of the activating fluid falls below a predetermined pressure.

BRIEF SUMMARY OF INVENTION

The foregoing objects and other features and advantages are obtained by a fluid actuated tool comprising a housing which includes a power end portion and a work engaging end portion. Disposed in the power end portion is a piston chamber in which a piston is moveably mounted. A fluid inlet controlled by a valve arrangement is provided to control the flow of fluid pressure into and out of the piston chamber to effect displacement of the piston between operative and inoperative position. At least a pair of work engaging members or jaws are pivotally mounted on the end of the work engaging portion to be actuated by a ram connected to the piston.

The valve arrangement is constructed so that, when actuated, pressure fluid is introduced into the piston chamber to advance the piston and associated ram to a protracted position to actuate the jaw members. Operatively associated with the valve controlling the exhaust port of the piston chamber is a bleed tube which is operatively connected to the valve controlling the exhaust port, and the bleed tube has a bleed port which is valved by the moving piston. The arrangement is such that the exhaust port is prohibited from venting the pressurized side of the piston chamber unless the bleed port has been placed in communication with the pressurized side of the piston chamber. This will occur only when the piston has been sufficiently advanced to effect the operation of the jaw members. When the bleed port has been placed in communication with the pressurized portion of the piston chamber, a portion of the pressurized fluid is by-passed to the valve controlling the exhaust port to valve the exhaust port to an open position so that the pressurized side of the piston chamber can be exhausted to atmosphere and thereby effect its release of the work piece. The return of the piston and associated ram is effected by a return spring.

In another embodiment an adjustment is provided whereby the force applied by the jaw members on the work piece can be adjusted within predetermined limits. This is attained by effecting an adjustment between position of the jaw members relative to the actuating ram.

FEATURES

A feature of this invention resides in a fluid pressure actuated tool which has a bleed tube which is operatively associated with an exhaust valve whereby the exhaust valve is actuated only when the piston has been sufficiently advanced to effect the proper work operation on a work piece.

Another feature resides in the provision of a pressure activated tool having work performing jaws which can be adjusted to vary the pressure which the jaws exert on a work piece.

Another feature resides in a fluid actuated tool having an improved valve construction for controlling the flow of fluid pressure into and out of the piston chamber.

Another feature resides in the provision of a bleed tube or by-pass having a bleed port and which bleed tube is associated with the valve construction so that when the bleed port is valved open by the piston as the piston is advanced toward its operative or work performing position, a portion of the pressurized fluid is by-passed to operate on the exhaust valve thereby effecting the release of the work piece only after the work performing operation of the jaw members has been completed.

Other features and advantages will become more readily apparent when considered in view of the drawings and specification in which.

DETAILED DESCRIPTION

Figures 1, 3:
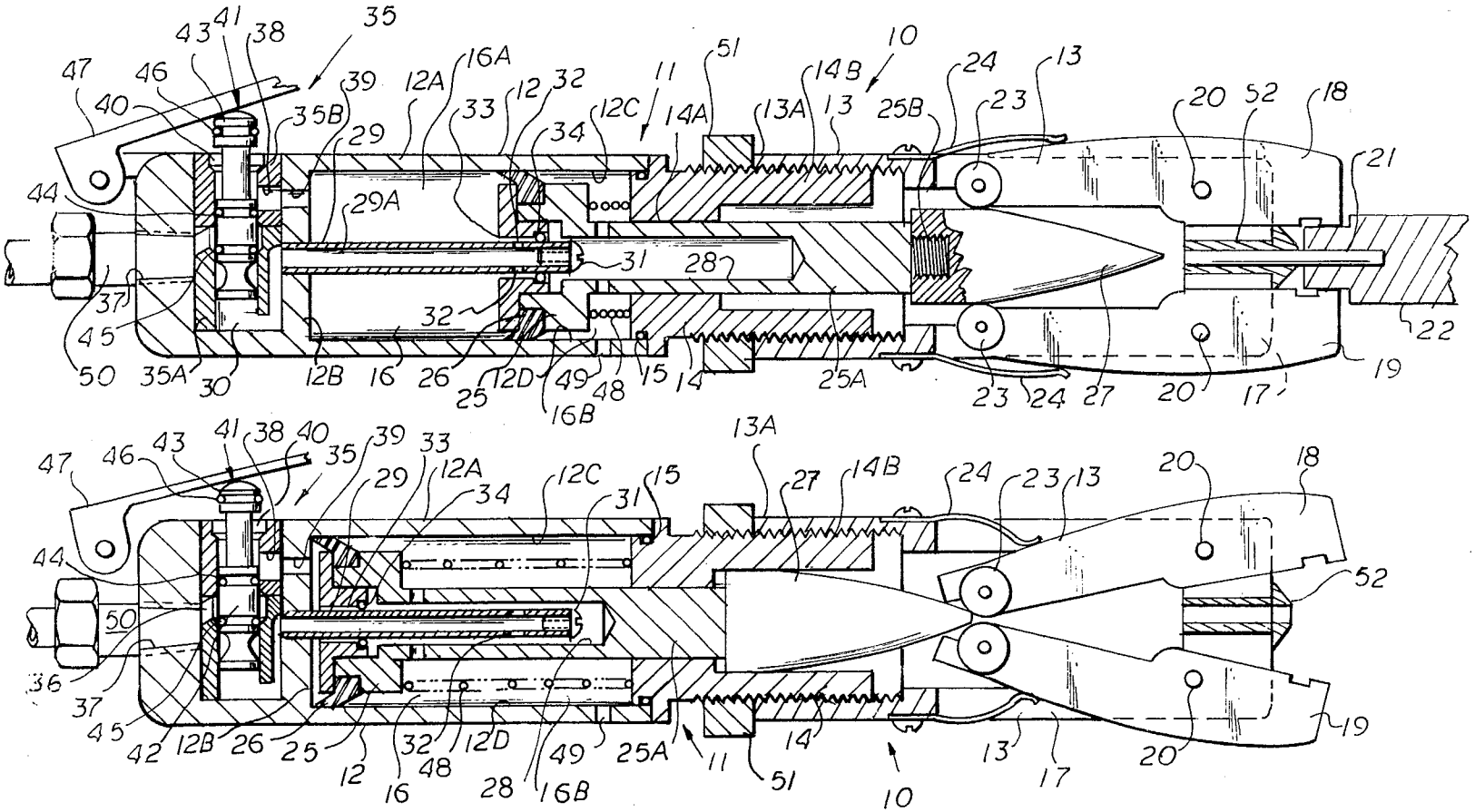
FIG. 1 is a longitudinal sectional view of a fluid activated tool embodying the present invention in which the parts are shown in an inoperative position.
FIG. 3 is a longitudinal sectional view similar to FIG. 1, but showing the parts in the protracted or operative position; the handle being shown in the release position.
Figure 2:
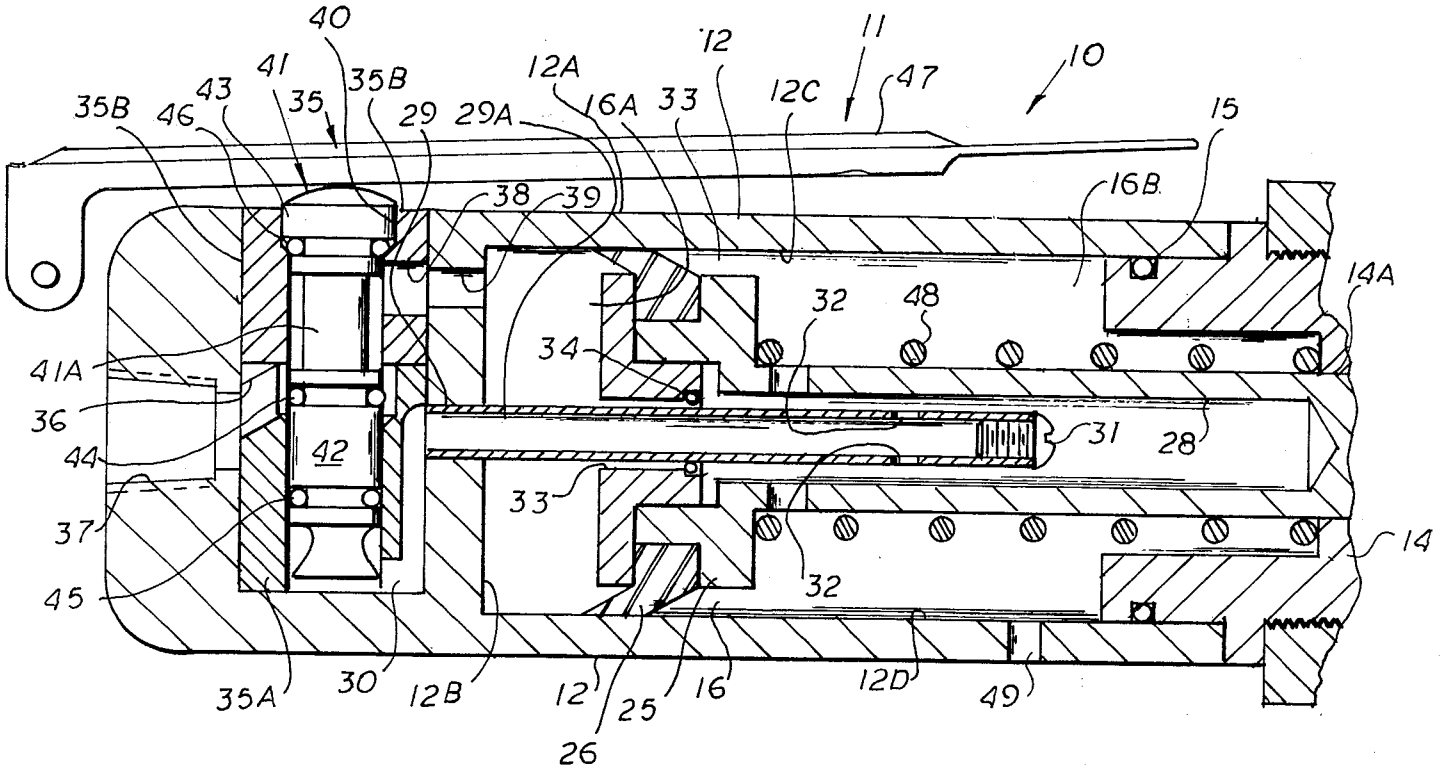
FIG. 2 is a fragmentary view similar to FIG. 1 showing the component parts in an intermediate position.
Figure 5:
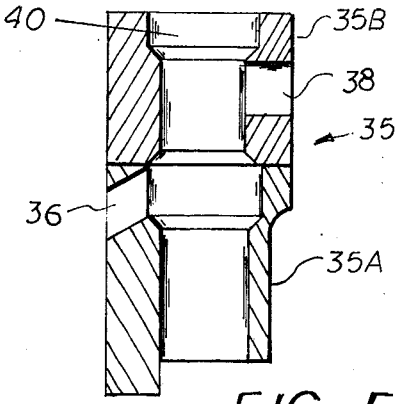
FIG. 5 is a detail sectional view of the valve body.
Figure 6:
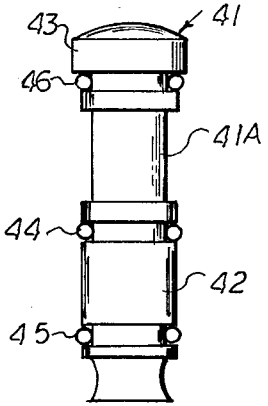
FIG. 6 is a detail showing of the valve member.

Referring to the drawings there is shown in FIGS. 1 to 3 a fluid actuated tool 10 embodying the present invention. The illustrated tool 10 is particularly useful for effecting a crimping or cutting operation as will be hereinafter described. The tool 10 comprises a housing 11 which includes a power end portion 12 and a work engaging portion 13. The power end portion 12 includes a tubular body portion 12A which is closed at one end by an end wall 12B and opened at its other end 12C. An end cap 14 is fitted to the open end 12C of the body 12 and is secured by any suitable means; e.g., by pins, set screws or the like. If desired, a suitable seal, such as an O ring 15 is dispose between the end cap 14 and the internal bore 12D of the body portion 12A to provide for a fluid tight seal therebetween. A piston chamber 16 is thus defined between the end wall 12B and the end cap 14.

The end cap 14 is provided in a central opening 14A for slideably receiving a piston rod 25A. Coupled to the external threaded portion 14B of the end cap is the work engaging portion 13 of the tool 10. As shown, the work engaging portion comprises an internally threaded portion 13A which is adjustably threaded to the end cap 14. The extended end of the work engaging portion is bifucated at 17. Pivotally mounted to the bifucated end portion 17 by suitable pivot pins 20 are at least a pair of opposed work engaging or jaw members 18 and 19.

In the illustrated form of the invention, the pivoted jaw members 18, 19 are illustrated as crimp forming jaws which when acutated will swedge or clamp a work piece; e.g., a pin or terminal 21 to a wire or other member 22. However, it will be understood that other types of jaw members may be provided to form other types of work operations on a workpiece. For example, if the jaws 18 and 19 were provided with a cutting edge, the tool 10 would be able to effect a cutting operation on a work piece. Also various other forming jaws could be substituted for jaws 18 and 19 if other forming operations were desired.

As shown, cam rollers 23 are rotatably journalled to the other end of the respective jaw members 18 and 19, and a flat spring 24 connected to the work engaging portion 13 is arranged to maintain a spring bias on the respective jaws 18 and 19.

Slideably mounted in the piston chamber 16 is a piston 25. The piston 25 includes a connected sealing ring 26 to effect a sliding seal as the piston 25 is displaced between an operative and inoperative position. Connected to the piston 25 and extending forwardly through opening 14A in the end cap 14 is piston rod 25A. The extended end of the piston rod 25A has a threaded portion 25B to which a tapered ram 27 is connected. As seen in FIG. 3, the ram 27 when extended to a protracted or operative position functions to cam the jaw members 18 and 19 toward an operative position to effect the crimp or cut; i.e., to a closed position onto a work piece to effect either the crimp or cut.

The piston rod 25A is formed with a longitudinally extending bore 28 which is adapted to slide over a bleed tube 29 as the piston 25 is displaced from a retracted position as shown in FIG. 1 to a protracted position as shown in FIG. 3.

The bleed tube 29 is connected at one end in communication with a valve chamber 30. The other end of the bleed tube 29 is closed, e.g., by an end screw or wall 31. Adjacent the closed end 31, the bleed tube is provided with a bleed port 32 which connects the internal passage 29A of the bleed tube 29 in communication with the pressurized side 16A of the piston chamber when the piston 25 is in the advanced or protracted position, as seen in FIG. 3.

As shown in FIGS. 1 to 3 the piston 25 is provided with an opening 33 disposed in alignment with the piston rod bore 28. A seal means in the form of an O ring 34 is fitted to the internal surface of the piston 25 to effect a seal between the moveable piston 25 and the bleed tube 29 which is fixed to the end wall 12B. As seen in FIGS. 1 and 2, the seal or O ring 34 effectively seals the bleed port 32 from the pressurized side 16A of the piston chamber until the piston 25 has been advanced to its operative protracted position, as seen in FIG. 3.

To control the flow of fluid pressure into the piston chamber 16 to effect operation of the tool, a valve means 35 is provided. The power end portion 12 of the housing 11 is formed with a valve chamber 30 adjacent the end wall 12B. A valve body 35 A B is disposed in the valve chamber 30. In the illustrated embodiment the valve body is defined by complementary lower and upper body portions 35A and 35B. The lower body portion 35A is provided with an inlet port 36 arranged in communication with a fluid inlet 37 formed in the power end portion 12 of the tool 10.

The upper valve body 35B includes an outlet port 38 arranged to communicate with the pressure side 16A of the piston chamber through a port 39 formed in end wall 12B. The upper valve body 35B also defines an axially aligned exhaust port 40.

A valve member 41 is reciprocally mounted in the valve body for sequentially opening and closing the ports for controlling the flow of fluid pressure into and out of the piston chamber 16A as will be hereinafter more fully described. As shown, the valving member 41 comprises a spool or stem 41A having serially connected thereto spaced apart valve heads 42 and 43. Disposed on either side of valve head 42, the valve stem 41A is provided with an annular groove for accommodating sealing rings 44 and 45. Another sealing ring 46 is disposed about the valve stem adjacent the upper valve head 43.

Pivotally mounted to the end of the housing 11 is a valve actuator 47. The valve operator comprises a hand lever which is pivoted at one end and which extends over the extended valve head 43 whereby the valve member can be readily depressed when the valve operator or lever 47 is depressed.

In the normal inoperative position, the valve member 41 is normally maintained in a projected position as shown in FIG. 1; i.e., with valve head 43 extended beyond the exhaust opening 40. This is because the fluid pressure will normally urge the valve toward the open exhaust port position as shown in FIG. 1.

With the component parts of the tool 10 thus described, the operation of the tool is as follows:

With the inlet 37 of the tool 10 suitably connected to a source of pressurized fluid, e.g., compressed air, through a connector 50, and with the handle or lever 47 in the inoperative position, as seen in FIG. 1, the position of the valve member 41 is such that the seals 44 and 45 effectively seal the pressurized fluid from the pressure side 16A of the piston chamber 16. In this position, the exhaust port 40 is opened to atmosphere. When the handle or lever 47 is depressed to a position shown in FIG. 2, the valve member 41 is displaced so that seal 46 valves the exhaust port 40 closed and seal 44 is displaced to connect the inlet port 36 in communication with ports 38 and 39 wherein the pressurized fluid is introduced into the pressure side 16A of the piston chamber. If the operating pressure of the compressed air is up to its proper operating pressure, the force of the fluid entering chamber 16A will effect displacement of the piston 25 to the right as seen in FIG. 3 and overcome the force of the return spring 48. Atmospheric air disposed on the non-pressurized side 16B of the piston chamber 16 is vented to atmosphere, e.g., through vent 49 formed in the housing portion 12.

As the piston 25 is advanced under fluid pressure, the ram 27 is protracted accordingly. In doing so the ram 47 will effect a camming action on the jaw members 18 and 19 to effect a work performing operation on a workpiece, e.g., crimping or cutting.

As the piston 25 is advancing to the right as seen in FIGS. 2 and 3, the piston seal 34 effectively seals off the bleed port 32 until the piston 25 has advanced its full stroke. When the piston 24 has advanced its full stroke and the jaw members 18 and 19 have performed their operation on the workpiece, seal 34 has advanced beyond the bleed port 32 thereby placing the bleed port 32 in communicaton with the pressurized side 16A of the piston chamber 16. With the handle or lever 47 depressed, as shown in FIG. 2, and prior to a release position as shown in FIG. 3, the jaw members 18, 19 are securely fixed to the work piece and remain in this position so long as the handle 47 is maintained depressed.

Upon release of the handle (FIG. 3), a portion of the pressurized air in chamber 16A which has been by-passed through the bleed port 32 and connected passage 29A to the valve chamber 30 and exerts a fluid pressure on the bottom of the valve stem 41A. The by-passed fluid pressure acting on the valve stem 41A effects a displacement of the valve to the upper position, as seen in FIG. 1, whereby seal 46 valves the exhaust port 40 open; and seal 44 effectively seals off the inlet port 36 from the outlet port 38 and the exhaust port 40. In this position of the valve 41, the spring 48 returns the piston to its retracted or inoperative position with the pressurized fluid or air in the pressurized side 16A of the piston 25 being exhausted through ports 39, 38 and 40 to atmosphere. In doing so the jaws effect the release of the work piece 22.

The foregoing cycle of operation is effected only if the activating fluid; e.g., compressed air is at proper operating pressures. In the event the operating pressure of the activating medium or air is not at a pressure sufficient to fully advance the piston 25 to effect the complete operation of the jaw member, it will be noted that the bleed port 32 will be sealed off from the pressured side 16A of the piston. So long as this condition remains the exhaust port 40 cannot be opened since the pressurized fluid required to actuate the valve to shift it to the open exhaust port position cannot be by-passed through the bleed port 32, until the piston 25 has been fully advanced. Thus with the construction described it will be impossible for an operator or worker to make a defective crimp or cut. When the fluid or air pressure is insufficient to fully advance the piston 25 to expose the bleed port 32, the jaws will either not completely close or lock onto the work piece without effecting the release of the work piece. Should this occur the worker is required to disconnect the conduit 50 from the air inlet 37 of the tool; or wait until the pressure of the operating fluid has reached the desired pressure. Because of the tool operation, a defective or improperly formed work operation cannot pass undetected.

In the embodiment of FIGS. 1 to 3, an adjustment is provided whereby the pressure exerted by the jaws 18 and 19 on a work piece 21, 22. This is readily attained by rotating the work engaging end portion 13 on the end cap 14 in one direction or the other to either advance or retard the relative position between the ram 27 and the jaw cam rollers 23. A suitable lock nut 51 is threaded to the end cap 14 to lock the work engaging end portion in the adjusted postion. Thus the pressure which the jaws 18 and 19 exert on the work piece can be varied without changing or altering the operating pressure of the fluid medium; e.g., compressed air.

Where the tool is used to crimp a pin or the like to the end of a wire or the like, the work engaging end portion 13 is provided with a suitable work holder or die 52.

Figure 4:
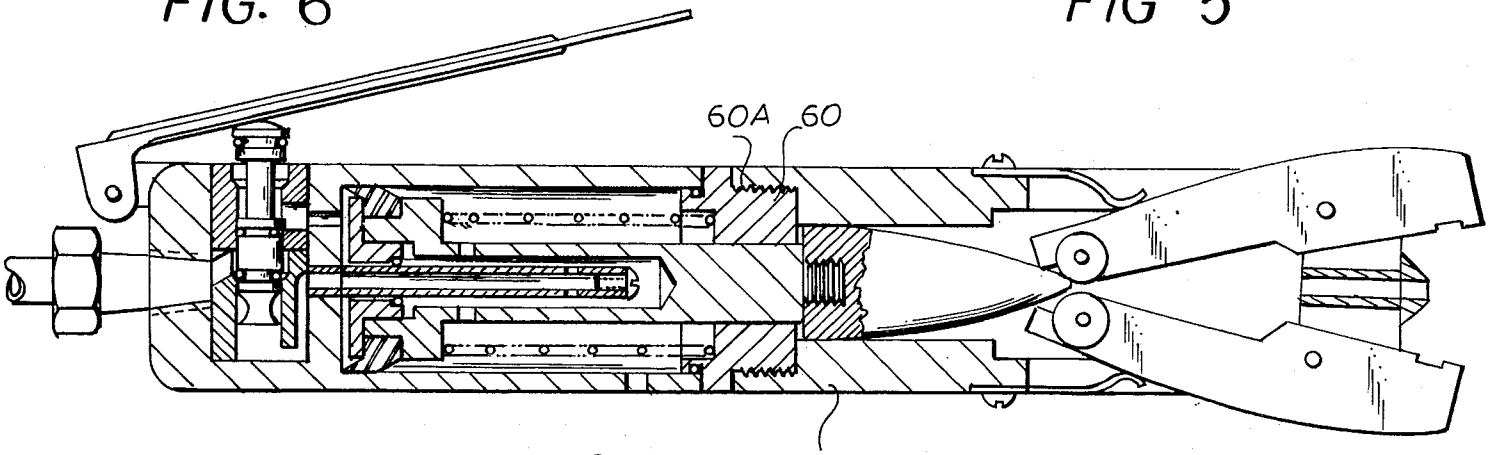
FIG. 4 illustrates a longitudinal section of a modified embodiment.

FIG. 4 illustrates a modified embodiment. This form of the invention is similar in all respects to the construction and operation of the tool 10 described with respect to FIGS. 1 to 3 except that in this form of the invention, no adjustment feature is provided for varying the jaw pressure. This embodiment differs in that the end cap 60 is provided with a shortened threaded portion 61A. Accordingly the work engaging portion 62 is fully threaded onto the end cap 60 and retained in a set position thereon. With this embodiment the lock nut 51 hereinbefore described is not needed. In all other respects the operation and structure is similar to that of FIGS. 1 to 3.

While the present invention has been described with respect to several embodiments thereof, it will be readily appreciated and understood that variations and modifications can be made without departing from the spirit or scope of the invention.

I claim:

1. A fluid actuated, work performing tool comprising:

a housing having a power end portion and a work engaging end portion, said power end portion defining a chamber, and said power end portion including a fluid inlet and an exhaust port adapted to be in communication with said chamber, a common valve means for sequencing the opening and closing of said inlet and exhaust port,
a piston moveably disposed within said chamber for movement between an operative and inoperative position,
a work engaging means is connected on said work engaging end portion,
a ram connected to said piston for movement between a retracted and protracted position for activating said work engaging means between an operative and inoperative position,
and a bleed tube extending internally of said chamber,
said bleed tube defining a passage,
said piston being slideably mounted on said bleed tube
and a port opening to said tube for connecting said passage with the pressure side of said chamber only in a fully protracted position of said piston only,
and said passage being in communication with said valve means whereby a portion of said fluid in said chamber is by-passed to said valve means only when said piston has protracted to a position beyond said port opening whereby,
said by-passed fluid activates said valve means to valve said exhaust port to an open position to exhaust said chamber whereby said piston and connected ram is returned to the retracted position.

2. A fluid actuated work performing tool comprising:
a housing having a power end portion and a work engaging end portion,
said power end portion defining a chamber,
said power end portion including a fluid inlet and an exhaust port adapted to be in communication with said chamber,
a valve means for sequencing the opening and closing of said inlet and exhaust port,
a piston moveably disposed within said chamber for movement between an operative and inoperative position,
a work engaging means connected to said work engaging end portion,
a ram connected to said piston for movement between a retracted and protracted position for activating said work engaging means between an operative and inoperative position,
and a bleed tube,
said bleed tube defining a passage,
and a port opening in said tube for connecting said passage with said chamber in the fully protracted position of said piston only,
and said passage being in communication with said valve means whereby a portion of said fluid in said chamber is by-passed to said valve means only when said piston has protracted to a position beyond said port opening whereby said by-passed fluid activates said valve means to valve said exhaust port to an open position so that said piston and connected ram is returned to the retracted position,
and wherein said work engaging means includes at least a pair of jaw members pivotally connected to said work engaging end portion for gripping a work piece between,
and wherein said valve means includes,
a valve body disposed in said power end portion adjacent said fluid inlet,
said valve body having a port opening adapted to communicate with said fluid inlet and a second port opening in communication with said chamber,
and an exhaust outlet,
and a valve stem having spaced apart valve heads disposed in said valve body for sequencing the introduction of pressurized fluid into said chamber and the exhausting of said fluid out of said chamber.

3. A pneumatically operated work performing tool comprising:
a housing having a power end portion and a work engaging end portion,
said power end portion including a tubular body portion which is closed at one end thereof and open at the other end thereof,
said closed end having a fluid inlet formed therein,
an end cap closing the open end of said tubular body to define a piston chamber,
said end cap having a opening formed therein;
said work engaging end portion being connected to said end cap,
at least a pair of jaw members connected to said work engaging end portion adapted for movement relative to each other,
a valve chamber disposed in said power end portion adjacent said fluid inlet,
a valve body disposed in said valve chamber,
said valve body having an inlet port in communication with said fluid inlet, an outlet port in communication with said piston chamber, and an exhaust port adapted to communicate with said outlet port,
a valve member including a valve stem having spaced valve heads for sequencing the opening and closing of said ports for controlling the flow of pressurized fluid into and out of said piston chamber,
a piston slideably disposed within said piston chamber,
a piston rod having an internal bore extending longitudinally thereof,
said piston rod extending through the opening of said end cap,
a ram connected to said piston rod to actuate said jaw members between operative and inoperative positions as said ram is protracted and retracted,
a bleed tube being connected at one end to said valve chamber and extending into said piston chamber,
said bleed tube being closed at its other end, and said bleed tube having a bleed port adjacent the closed end of said bleed tube,
said piston being slideably disposed on said bleed tube,
means for prohibiting the fluid pressure in said chamber from exhausting through said bleed tube port until said piston has advanced along said bleed tube to a position beyond said bleed port, whereby a portion of said pressurized fluid is by-passed to said valve chamber to effect displacement of said valve member for closing of said fluid inlet and opening of said exhaust port.

4. The invention as defined in claim 3 and including means for adjusting the position of said work engaging end portion relative to said end cap whereby the pressure exerted by the jaw members on a work piece can be adjusted accordingly.

5. A fluid actuated, positive work performing tool comprising:
a housing defining a piston chamber, work engaging means mounted on said housing for perfecting a work performing operation on a work piece, activating means for operating said work engaging means between an operative and inoperative position, said activating means including a piston moveably mounted in said piston chamber and a ram connected to said piston to move therewith whereby said ram is moved between a protracted operative position and a retracted inoperative position as said piston is displaced in said chamber to render said work engaging means operative and inoperative accordingly, a valve means for controlling the flow of fluid into said chamber to effect displacement of said piston, means for activating said valve means for introducing a fluid pressure into said chamber, a bleed tube connected in communication with said valve means and extending internally into said chamber, said bleed tube being closed at its inner end, and said bleed tube having a bleed port adjacent its closed end, said piston being slideably mounted on said bleed tube, and means on said piston for prohibiting the fluid pressure in said chamber from exhausting through said bleed tube port to said valve means until said piston had advanced along said bleed tube to a position sufficient to advance said ram to an operative protracted position whereupon said bleed port is disposed in communication with the pressure side of said chamber so that a portion of said pressurized fluid is by-passed through said bleed tube to said valve means to effect the deactuation of said valve means and the exhausting of said fluid pressure operating on said piston to atmosphere through said valve means.

6. The invention as defined in claim 5 and including means for adjusting the amount of pressure said work engaging means exerts on a work piece in the operative position thereof, said adjusting means including an end cap connected to said housing, and said end cap and work engaging means having complementary coupling means whereby said work engaging means can be longitudinally adjusted relative to said end cap.

* * * * *